US009989336B2

(12) United States Patent
Purvis

(10) Patent No.: US 9,989,336 B2
(45) Date of Patent: Jun. 5, 2018

(54) DEVICE FOR NON-LETHAL IMMOBILIZATION OF THREATS

(71) Applicant: James W. Purvis, Albuquerque, NM (US)

(72) Inventor: James W. Purvis, Albuquerque, NM (US)

( * ) Notice: Subject to any disclaimer, the term of this patent is extended or adjusted under 35 U.S.C. 154(b) by 25 days.

(21) Appl. No.: 15/436,472

(22) Filed: Feb. 17, 2017

(65) Prior Publication Data

US 2017/0160060 A1 Jun. 8, 2017

(51) Int. Cl.
*F41H 13/00* (2006.01)
*F42B 12/66* (2006.01)
*F42B 10/06* (2006.01)

(52) U.S. Cl.
CPC ..... *F41H 13/0006* (2013.01); *F42B 10/06* (2013.01)

(58) Field of Classification Search
CPC ..... F42B 12/68; F42B 12/362; F42B 6/003; F42B 12/66; F41H 13/0006
USPC ..... 102/501–504; 89/1.34
See application file for complete search history.

(56) References Cited

U.S. PATENT DOCUMENTS 4,559,737 A 12/1985 Washington
4,656,947 A 4/1987 Gordon et al.
4,664,034 A 5/1987 Christian
4,912,869 A 4/1990 Govett
5,315,932 A 5/1994 Bertram
5,326,101 A 7/1994 Fay
5,561,263 A 10/1996 Baillod
5,649,466 A 7/1997 Genovese
5,698,815 A 12/1997 Ragner
5,706,795 A 1/1998 Gerwig
5,898,125 A 4/1999 Mangolds et al.
6,283,037 B1 9/2001 Sclafani
6,381,894 B1 5/2002 Murphy
6,854,374 B1 * 2/2005 Breazeale ..... F41H 5/08 102/502
7,640,860 B1 1/2010 Glover et al.
7,752,974 B2 7/2010 Wenass et al.
7,908,972 B2 3/2011 Brunn
7,963,278 B2 * 6/2011 Makowski ..... F41B 3/04 124/41.1
8,141,493 B1 * 3/2012 Kuchman ..... F41H 13/0006 102/439
8,671,841 B2 3/2014 Raquin et al.
9,134,099 B2 * 9/2015 Tseng ..... F41H 13/0006
(Continued)

OTHER PUBLICATIONS

Concepts in Ammunition (www.conceptsinammunition.com).
Security Devices International (www.securitydii.com).
Advanced Ballistics Concepts (www.mibullet.com).

*Primary Examiner* — Reginald Tillman, Jr.

(57) ABSTRACT

The present invention discloses a projectile device for the nonlethal immobilization of threats. The invention includes a plurality of grappling-type hooking assemblies attached by a flexible means to a projectile core, a means for the dispersal of the hooking assemblies on or just prior to impact on a target, and a means for ballistically deploying the device from a 12 gauge shotgun, a 35 mm flare gun, a 40 mm grenade launcher, or other suitable launching device. In particular, the hooking assemblies disperse and adhere to the target, while the flexible attachment means entangle and either limit the motion of or immobilize the target.

19 Claims, 6 Drawing Sheets

(56) References Cited

U.S. PATENT DOCUMENTS

2015/0168107 A1* 6/2015 Tseng ..... F41H 13/0006
124/56
2017/0276461 A1* 9/2017 Norris ..... F42B 12/66

* cited by examiner

DEVICE FOR NON-LETHAL IMMOBILIZATION OF THREATS

FIELD OF THE INVENTION

This invention relates generally to less-lethal shot cartridges, and in particular presents a bola-type snaring and entanglement device for true non-lethal immobilization of an adversary.

BACKGROUND OF THE INVENTION

A major issue presently facing Law Enforcement officers is the use of deadly force in situations when the use of non-lethal means would be more appropriate. Unfortunately, there are documented cases of almost every type of non-lethal device producing fatalities, resulting in non-lethal weapons now being termed "less-lethal" weapons in the literature.

Less-lethal force alternatives include chemical spray deterrents which are projected in a stream at a potential attacker, and "stun guns" which incapacitate a targeted individual at close range with electrical current. These devices, although usually achieving non-lethal force, require that an additional alternative device be used in place of the ordinary service weapon. In addition, these options are viable only at close range.

Another alternative to deadly force is the use of non-lethal ammunition as a deterrent. The use of such ammunition has the advantage that it may be used with conventional firearms. The psychological deterrent of the standard firearm is maintained. The substitution of lethal munitions to replace the non-lethal ammunition in an escalating situation is much more easily effected compared to the stun-gun or chemical spray devices. In addition the range of less-lethal ammunition is much greater, thereby providing expanded tactical options.

There are a few immobilization devices available for single operator carry and use. Such devices are typically some form of deployable net or bola projectile device, both of which have limited ranges and some deployment problems. In view of the foregoing, there is a need for an improved truly non-lethal round which may be accurately fired from standard firearms. The present invention addresses this and other needs.

RELATED ART FOR NON-LETHAL IMMOBILIZATION OF THREATS

As of 2017, the existing literature contains a multitude of related art patents and commercial devices. These devices are generally categorized as either incapacitants or deterrents, and since all forms apparently have produced some lethal results, they are now described as "less-lethal" rather than "non-lethal". "Less-lethal" devices include aerosols and chemicals, such as pepper spray and CS gas; impact or stun rounds, including wooden dowels, rubber slugs, rubber pellets, and ballistic bean-bags; diversionary or distraction rounds, such as flash-bang projectiles, and the category of the present invention: nets, bolas, and other entanglement rounds.

In the commercial venue, by way of example, companies such as Concepts In Ammunition (www.conceptsinammunition.com) produce deterrent less-lethal twelve gauge rubber bullet shotgun rounds. Security Devices International (www.securitydii.com) produces advanced less-lethal chemical systems such as 40 mm malodorant rounds.

Advanced Ballistics Concepts (www.mibullet.com) produces the "Stinger", a less-lethal multiple-impact bola-type bullet with tether-connected fragments.

Patents for conventional less-lethal devices include, by way of example, U.S. Pat. No. 4,656,947 to Gordon, et al., which discloses rifle launched canister ammunition for mob dispersion which is attachable to the flash suppressor, or to a grenade launcher adaptor. The canister contains short rubber cylinders stacked so as to form several cylindrical columns. U.S. Pat. No. 7,908,972 to Brunn describes a flare-bang projectile. U.S. Pat. No. 8,671,841 to Raquin, et. al., discloses a kinetic munition or projectile with controlled, less-lethal effects. U.S. Pat. No. 6,283,037 to Sclafani discloses a non-lethal shotgun round consisting of an elastic bag with packed particulate load in wad to which a dye may be added. U.S. Pat. No. 7,752,974 to Wenass et al. discloses a device providing apparatuses for use in launching an inhibiting powder which becomes aerosolized. U.S. Pat. No. 5,698,815 to Ragner describes an electronic projectile with electrodes which on impact penetrate the skin of the target making electrical contact with internal tissue of a target, similar to a Taser. Electric pulses discharge for several seconds to incapacitate the target. Long-term incapacitation is accomplished with a syringe filled with a tranquilizing fluid mounted within a foam rubber tip. On impact this fluid is forced into the target through needle, with the stun effect of the electrical discharge giving the tranquilizer time to work. Another impact-actuated projectile concept is disclosed in U.S. Pat. No. 7,640,860 to Glover, et al. An actuator within the projectile causes a containment area to peel back upon itself on impact and release a stored mass of core particles.

Several devices are available which utilize nets or bags to immobilize targets. U.S. Pat. No. 5,326,101 to Fay discloses a law enforcement baton using a net deployed by a compressed air canister to entrap a criminal suspect. The net is directed at and impacts the upper torso region of the suspect and envelops the suspect's arms. U.S. Pat. No. 4,912,869 to Govett discloses a rifle-type net gun with a plurality of barrels connected to the manifold. Each barrel is adapted to receive a projectile which has an inner bore that is closely fitted over the external diameter of the barrel. U.S. Pat. No. 5,898,125 to Mangolds, et al., discloses a cartridge comprising a ballistically deployed weighted restraining net, a deployment charge, and a net spreader charge. U.S. Pat. No. 5,649,466 to Genovese discloses a rapidly deployable restraining system which comprises an assembly of inflatable confinement devices housed in a dispersion package.

Several external launch tube attachments for firearms have been designed to deploy bolas or bola-type entanglement devices. U.S. Pat. No. 4,559,737 to Washington discloses a firearm that fires two laterally separated tethered projectiles. The projectiles are intended to separate to a wider distance during flight, and are further intended to wrap around the legs of a fugitive in bolas fashion. This is a similar concept to the aforementioned Govett net gun but using bolas instead of nets. Similar to the Washington device is U.S. Pat. No. 5,706,795 to Gerwig which discloses a launcher tube wherein a forward end of the launch tube is provided with a deflector for deflecting two projectiles radially outward from said tube. Further, U.S. Pat. No. 6,381,894 to Murphy also discloses a bola deployment device attachable to the end of a firearm. The device has a plurality of tubular segments with pockets for inserting a bola weight and a stowage area for placing the bola cord.

The use of cartridges and munitions containing fettered or tethered shot is well known in the literature, as exemplified in U.S. Pat. No. 4,664,034 to Christian. The fettered shot enables eight or more pellets to be discharged in a tight group and in a manner which increases the effective range of the firearms. Such munitions are often found to experience tangling of the shot, or other malfunctions causing the pattern of the traveling shot to be unpredictable.

Both the bola cartridge and the fettered-shot cartridge entanglement concepts have been enhanced by incorporating snaring hooks. U.S. Pat. No. 5,315,932 to Bertram discloses a cartridge projectile system which employs three or four fettered buckshot paired with an equal number of twinned fish hooks connected by a thin strong line. The lines are joined at a single site, and are housed within the cartridge in a compacted state. The fish hooks are separately housed adjacent the rear of the cartridge. The buckshot are separately housed adjacent the front of the cartridge. When fired, the projectile system deploys with an assured wide pattern. A similar idea is U.S. Pat. No. 5,561,263 to Baillod, which discloses an ensnaring shot cartridge comprised of a pair of projectiles, each having a recessed hook, and both connected by a flexible tether. The projectiles are designed to diverge on exit from the firearm so as to extend the tether between them. The hooks maintain a retracted position after launch, but slide to an extended position by inertia when the device impacts a target.

SUMMARY OF THE INVENTION

It is an object of the invention to provide a firearm round which may immobilize a targeted individual without using lethal force. Externally, the device is configured as either a 12-gauge shotgun round, a 35 mm flare gun projectile, or a 40 mm mortar type projectile. The projectile is a bola-type device having multiple tethered dispersible hooking assemblies each with a plurality of grappling-type treble hooks attached to swivel points on each hooking assembly. The device is fin-stabilized during flight from gun barrel to target. The device is impact-actuated so as to deploy on impact with the target and then entangle the target.

A unique advantage of the present invention is true non-lethal immobilization of a threat without the possibly of serious bodily harm. Multiple uses of the device against a single target will not result in any increased probability of serious harm.

BRIEF DESCRIPTION OF THE DRAWINGS

The accompanying drawings, which are incorporated in and form part of the specification, illustrate various principles of operation and examples of the present invention, including a preferred embodiment of the invention, and, together with the detailed description, serve to explain the principles of the invention.

DETAILED DESCRIPTION OF THE INVENTION

Best Mode

The present invention will now be described more fully hereinafter with reference to the accompanying drawings, wherein like numbers refer to like elements throughout. It is to be understood, however, that the detailed description of the various embodiments and specific examples, while indicating preferred and other embodiments of the present invention, are given by way of illustration and not limitation. This invention may, however, be embodied in many different forms and should not be construed as limited to the embodiments set forth herein. Rather, these embodiments are provided so that this disclosure will be thorough and complete, and will fully convey the scope of the invention to those skilled in the art. Many changes and modifications within the scope of the present invention may be made without departing from the spirit thereof, and the invention includes all such modifications.

Figure 1A:
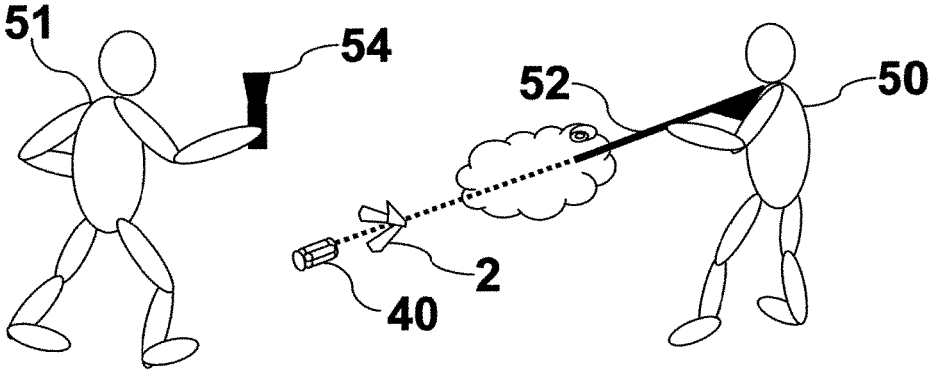
FIGS. 1A, 1B, and 1C illustrate three steps in the use of the invention.
Figure 1B:
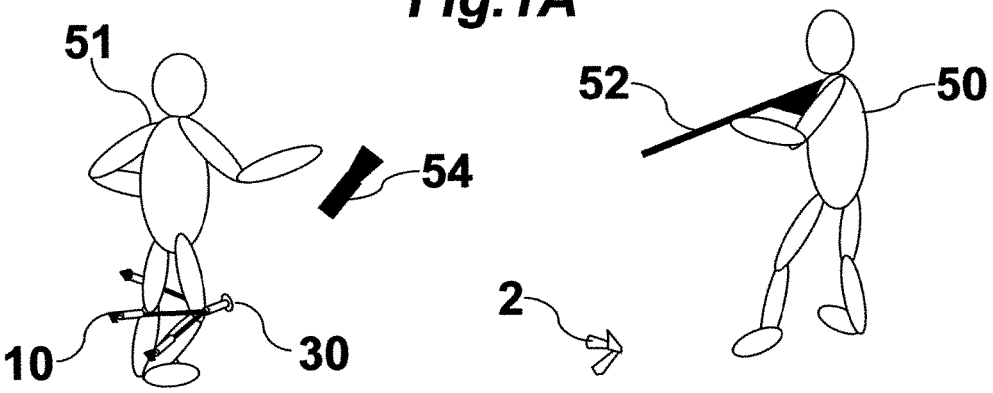
Figure 1C:
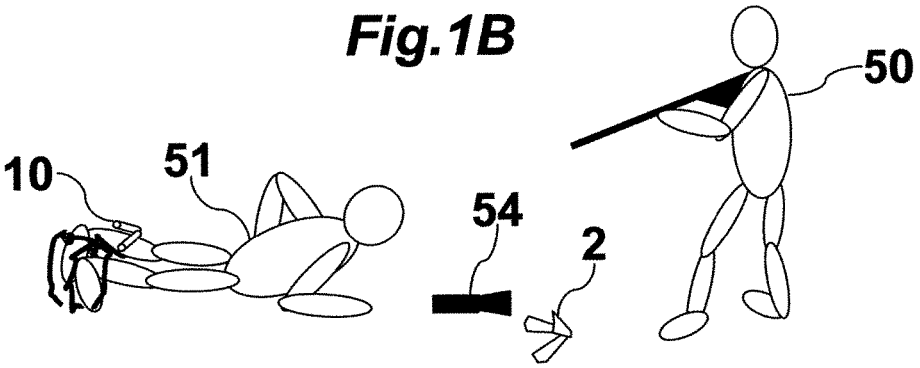

The basic situation for use of the present invention is illustrated in FIG. 1, wherein FIGS. 1A, 1B, and 1C illustrate three steps in the use of the invention. In FIG. 1A a defendant 50 fires projectile 40 from firearm 52 toward the knees and ankles of attacker 51 who is armed with a non-lethal weapon 54. Protective cover 2 separates from the projectile core 40 after the projectile exits the firearm 52. In FIG. 1B the projectile 40 impacts the knees of attacker 51 and hooking assemblies 10 deploy on impact. In FIG. 1C the hooking assemblies 10 have fully deployed and entangled the lower legs of attacker 51, immobilizing the legs and causing attacker 51 to fall.

Figure 2:
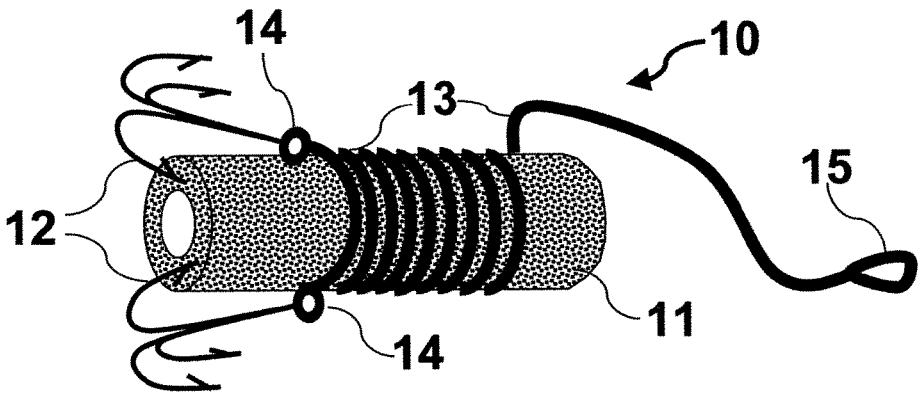
FIG. 2 presents a section side view illustrating the specific parts of a preferred embodiment.

Components of the grappling-type hooking assembly 10 are shown in FIG. 2. A plurality of treble hooks 12 are attached at swivel points 14 to a hooking assembly core 11. Retaining line 13 is shown in the stored condition wrapped around the hooking assembly core 11. The leftmost end of restraining line 13 is attached to the hooking assembly core 11 at the longitudinal position of the swivel points 14. The rightmost free loop 15 of retaining line 13 is attached during further construction to the projectile central core as subsequently illustrated in FIG. 4.

Figure 3:
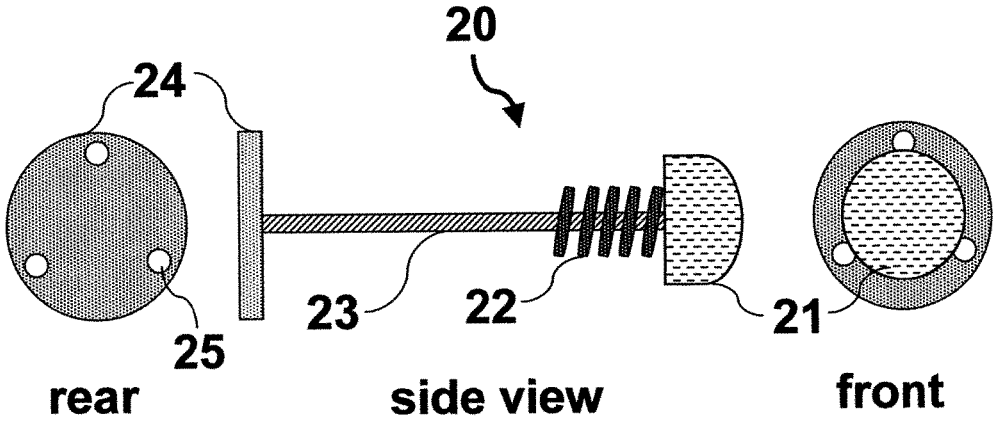
FIG. 3 presents a schematic illustrating a grappling-type hooking assembly.

Rear, side and front views of the four major components of the retainer and deployment mechanism assembly 20 are shown in FIG. 3. Retainer plate 24 and impact nose 21 are rigidly fixed to opposite ends of deployment rod 23. Retaining spring 22 ensures proper positioning of retainer plate 24 until impact with a target. Holes 25 are used to constrain deployment of hooking assemblies until impact with a target.

Figure 4:
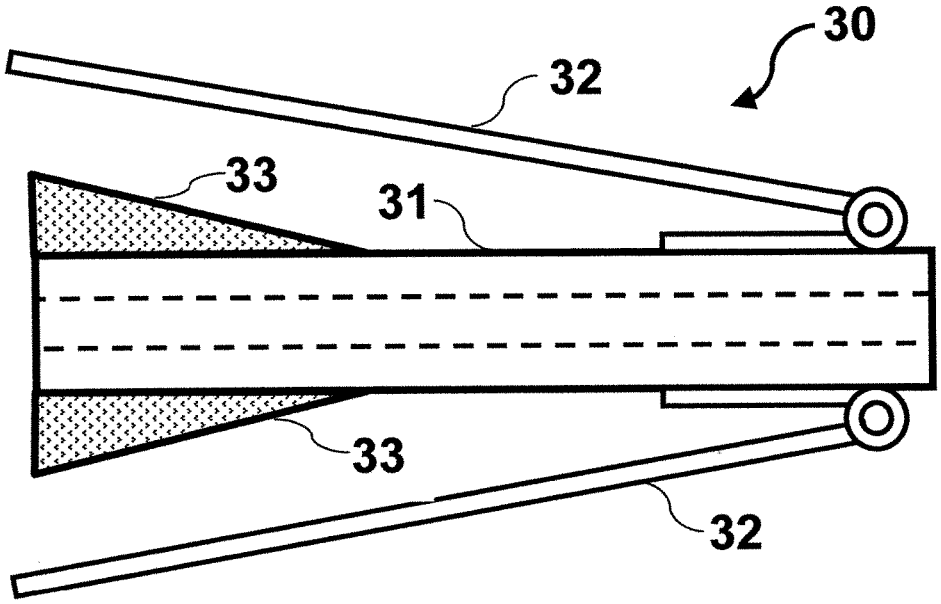
FIG. 4 presents rear, front, and side views illustrating the features of the hooking assembly retainer and the deployment mechanism.

FIG. 4 is an external view illustrating the construction of projectile central core assembly 30, which assembly consists of a central core support tube 31, a plurality of deployment springs 32, and a plurality of stabilizing fins 33. As shown in FIG. 4, each deployment spring 32 is designed with a long straight section on one end, a central tension coil, and a short straight section on the opposite end. The shorter segment of deployment spring 32 is rigidly attached to the central core support tube 31.

Figure 5:
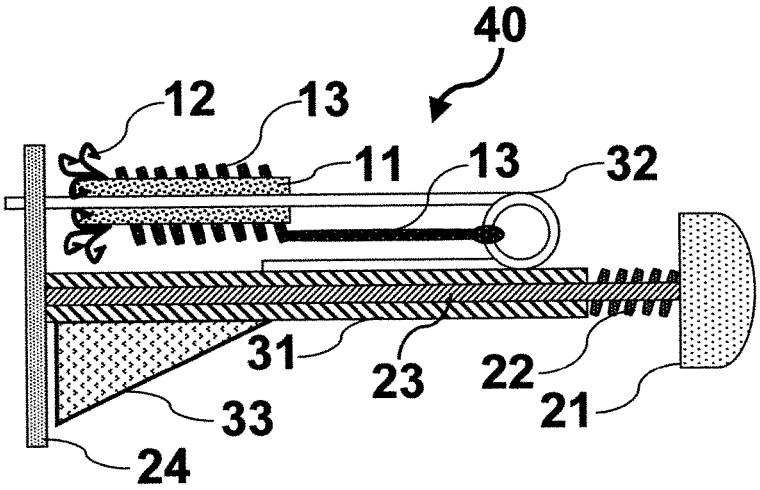
FIG. 5 presents a schematic illustrating the central core with stabilizing fins and hooking assembly deployment spring.

FIG. 5 presents a section side view illustrating the specific parts of a preferred embodiment of the complete projectile assembly 40, which is comprised of a plurality of hooking assemblies 10, a retainer and deployment mechanism assembly 20, and a projectile central core assembly 30. Individual components of assemblies 10, 20 and 30 are illustrated in the stowed, pre-firing condition. Note that retainer plate 24, which is attached to retainer rod 23, secures deployment spring 32. Retainer plate 24 is held in place by retaining spring 22, which pushes central core 31 and impact nose 21 apart.

Figure 6:
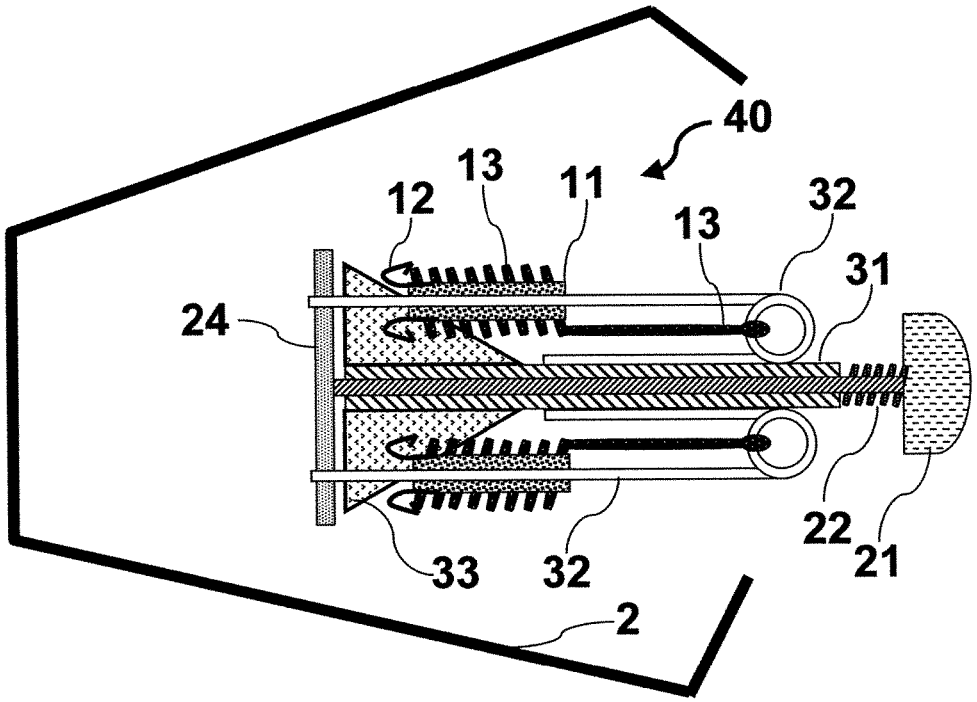
FIG. 6 presents the section side view of FIG. 2 illustrating separation of the protective cover immediately after launch.

FIG. 6 presents the section side view of projectile assembly 40 illustrating separation of the protective cover 2 immediately after the projectile assembly clears the firearm barrel. Protective cover 2 has begun to aerodynamically separate from the remainder of the projectile assembly 40. Retaining ring 22, pushing central core 31 and impact nose 21 apart, ensures that retainer plate 24 maintains the deployment springs 32 in the storage position, by means of the holes in retainer plate 24, until the projectile assembly impacts a target.

Figure 7:
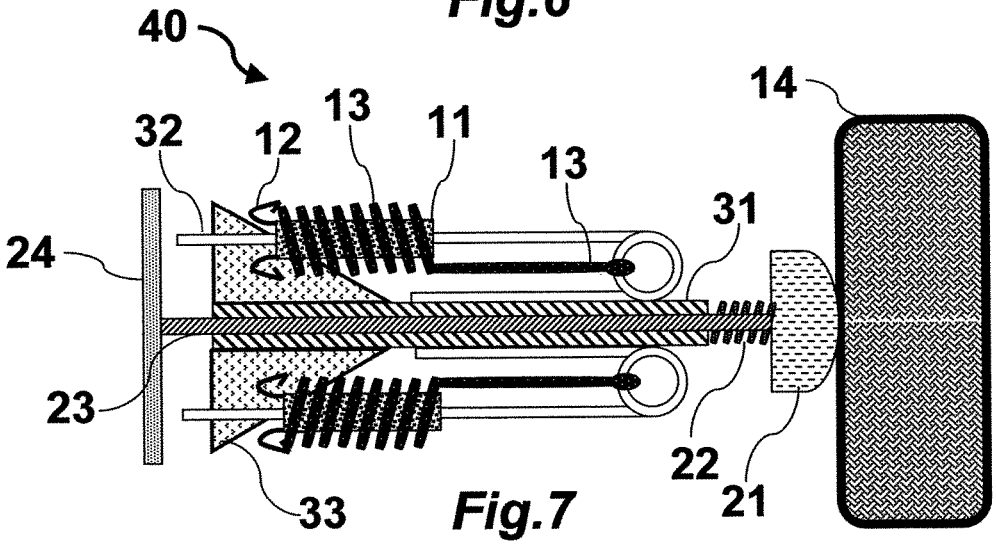
FIG. 7 presents the section side view of FIG. 2 illustrating retainer release of the deployment springs at target impact.

FIG. 7 presents the section side view of FIG. 2 just microseconds after contact of impact nose 21 with target 14. The contact causes impact nose 21 to compress retaining spring 22 while pushing retainer rod 23 rearward through central core tube 31 just enough to separate retainer plate 24 from deployment springs 32.

Figure 8:
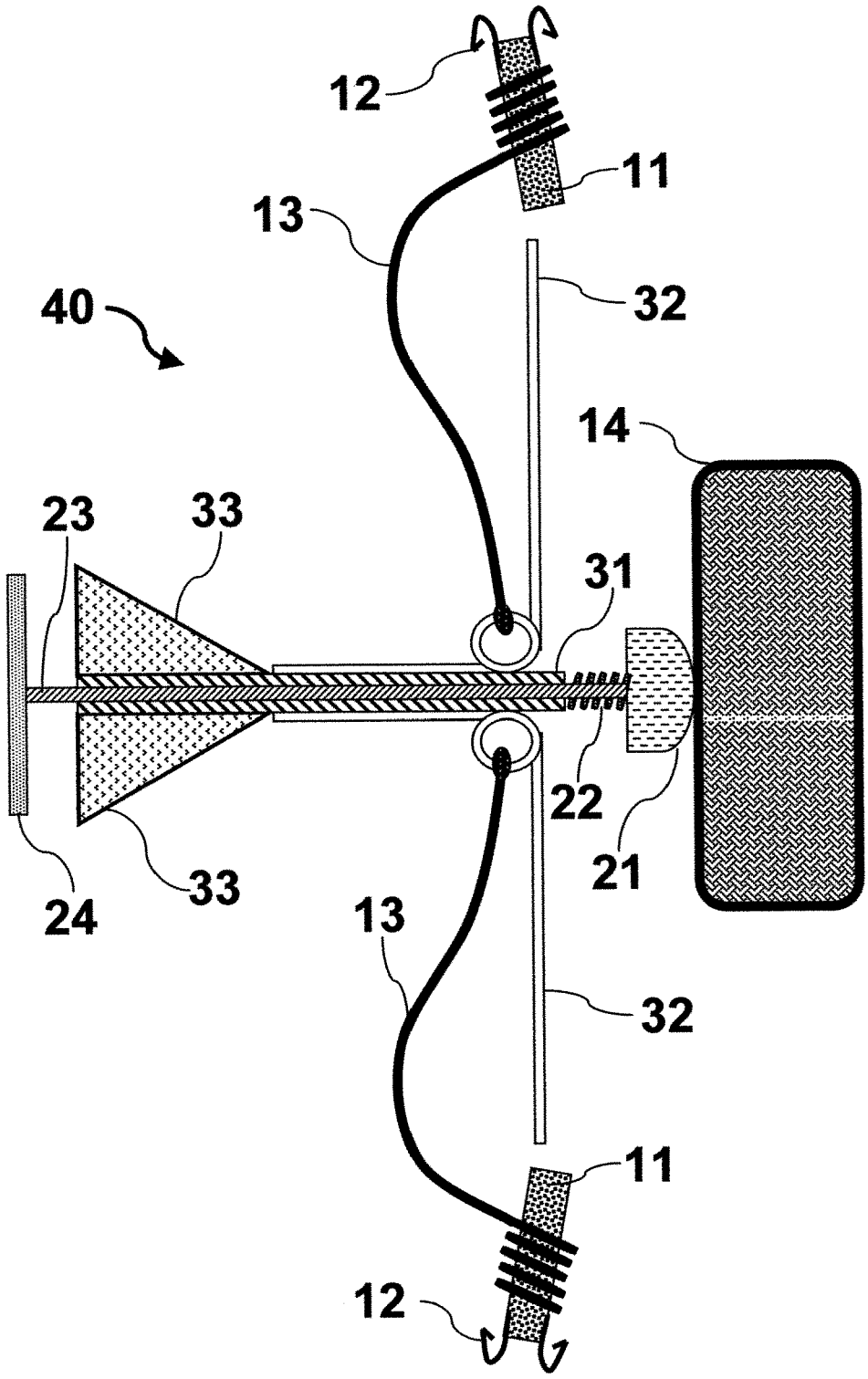
FIG. 8 presents the section side view of FIG. 2 illustrating deployment of the hooking assemblies after target impact.

In FIG. 8, deployment springs 32 have uncoiled from their storage positions and the coiled spring energy deploys hooking assemblies 10, comprised of elements 11, 12, and 13, outward. The radial momentum imparted to the hooking assemblies 10 by the deployment springs 32 cause the hooking assembly cores 11 to deploy off of the deployment springs 32 and move perpendicularly away from projectile central core 31. Retaining lines 13 begin to uncoil from their storage positions on the hooking assembly cores 11.

Figure 9:
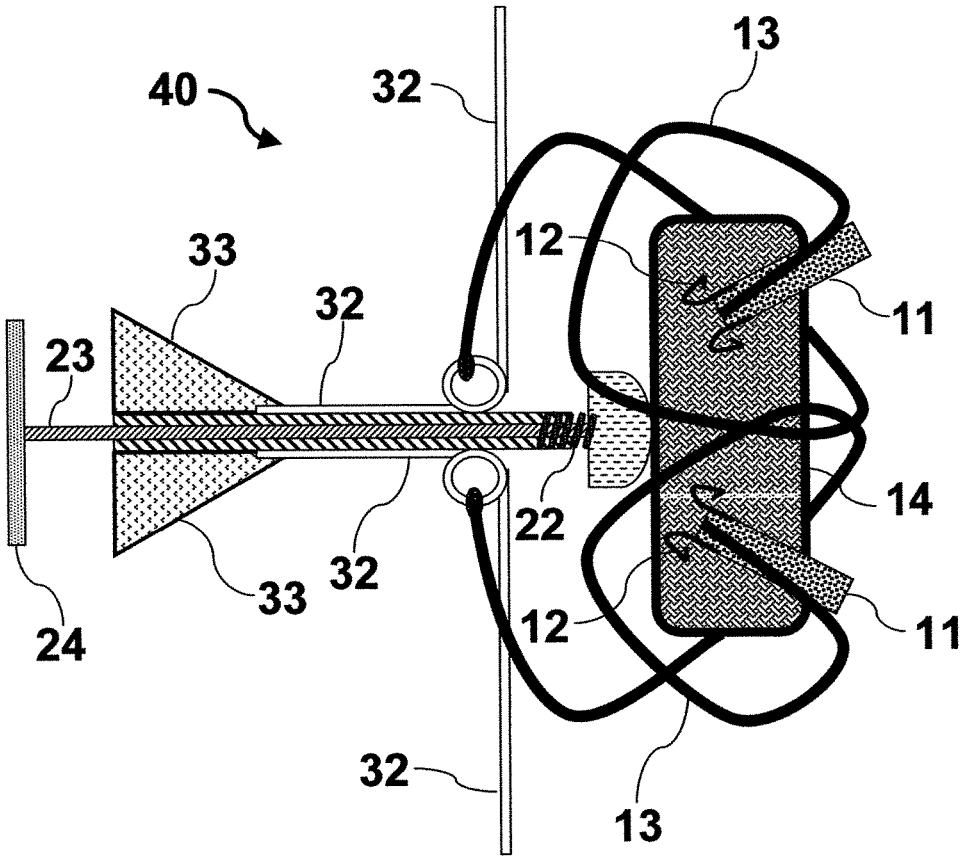
FIG. 9 presents the section side view of FIG. 2 illustrating entanglement of the hooking assemblies after target impact.

FIG. 9 illustrates the final step in the process. The combination of forward velocity from projectile launch and radial velocity imparted from deployment springs 32 cause hooking assemblies 10 to whip around and subsequently entangle target 14. Grappling hooks 12 attach to target 14, while retaining lines 13 fully unwind to entangle and restrain target 14. Hooking assembly components remain connected to each other through attachment to the deployment springs 32, which are rigidly connected to the central core of the projectile.

In view of the foregoing, it is obvious that the present invention provides a truly "non-lethal" round that can be reliably fired from standard firearms to entangle a targeted person's legs without causing harm. This round has adequate accuracy, range, reliability and immobilization capability to be used interchangeably with conventional ammunition for a variety of weapons in multiple tactical situations. The present invention offers improved accuracy over other existing options due to the fact that it travels as a compact fin-stabilized projectile from firearm barrel to target. The present invention is unique in that the entanglement device deploys upon impact with the target. The present invention has improved functional reliability due to the fact that the retaining lines deploy from the individual dispersion devices, thereby minimizing the possibility of malfunction due to premature line entanglements. The present invention has further improved reliability over other existing devices because the entanglement devices more readily and securely attach to the target after deployment due to the multiple treble hooks attached on swivels to each individual dispersion assembly. The use of this non-lethal round has the additional advantage of minimizing harm to non-targeted bystanders.

It is to be understood that even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed. The invention includes all such changes and modifications made within the scope of the present invention without departing from the spirit thereof.

What is claimed is:

1. A projectile device comprising:
a central core support tube;
one or more hooking assemblies,
a perforated retainer disc to constrain deployment of the one or more hooking assemblies until impact with a target;
a plurality of flexible fins;
an impact rod;
one or more deployment springs to deploy the one or more hooking assemblies
one or more connecting lines:
a disposable protective cover casing for enclosing the device;
wherein the projectile device is launched toward a target and deploys the one or more hooking assemblies on impact so as to entangle the arms or legs of the target.

2. A projectile device according to claim 1, wherein the projectile central core support tube is a hollow tube.

3. A projectile device according to claim 1,
wherein each hooking assembly is comprised of a plurality of treble hooks attached to individual swivel points on a hooking assembly core.

4. A projectile device according to claim 1,
wherein the retainer disc is a thin perforated and slotted disc.

5. A projectile device according to claim 1,
wherein the retainer disc retains the hooking assemblies stored and attached to the central core support tube during flight.

6. A projectile device according to claim 1, wherein the flexible fins for stabilizing the projectile device is comprised of arrow fletching.

7. A projectile device according to claim 1,
wherein the impact rod is comprised of a blunt hemispherical impact nose and a central rod.

8. A projectile device according to claim 1,
wherein the impact rod initiates deployment of the one or more hooking assemblies on impact with a target.

9. A projectile device according to claim 1,
wherein a retaining spring maintains the impact rod, impact nose and retainer disc combination in a spring-tensioned configuration wherein each hooking assembly and deployment spring are securely stowed and attached to the central projectile device core support tube until impact.

10. A projectile device according to claim 1 wherein the one or more deployment springs deploy and disperse the hooking assemblies from the central core support tube on impact.

11. A projectile device according to claim 1 wherein the connecting lines for connecting the hooking assemblies to the projectile device central core support tube consist of nonmetallic flexible cords.

12. A projectile device according to claim 11 wherein the nonmetallic flexible cords of the connecting lines are comprised of one or more of the following: nylon monofilament, nylon braid, Kevlar monofilament, Kevlar braid, and graphene fibers.

13. A projectile device according to claim 1
wherein the connecting lines for connecting the hooking assemblies to the projectile device central core support tube consist of flexible metallic lines.

14. A projectile device according to claim 13 wherein the said flexible metallic lines of the connecting lines for attaching the hooking assemblies to the projectile device central core support tube are comprised of one or both of the following: thin piano wire or fine braided steel cable.

15. A projectile device according to claim 1
wherein the connecting lines for connecting each hooking assembly to the projectile central core support tube are removably wound around the hooking assembly core until deployment, and further wherein said connecting lines unwind from the hooking assembly core during deployment.

16. A projectile device according to claim 1
wherein each hooking assembly core is non-permanently attached to the projectile device central core support tube, and wherein each hooking assembly core separately detaches from the projectile device at target impact.

17. A projectile device according to claim 1 wherein the flexible fins for stabilizing the projectile device during flight are attached along the rear of the central core support tube.

18. A projectile device according to claim 1 wherein the protective cover is a disposable tubular protective cover that encloses the projectile device during storage.

19. A projectile device according to claim 18 wherein the disposable tubular protective cover separates aerodynamically from the projectile device after launch.

* * * * *